United States Patent [19]

Hillman

[11] Patent Number: 4,666,417

[45] Date of Patent: May 19, 1987

[54] FLEXIBLE TUBULAR TOY

[76] Inventor: Paul D. Hillman, 1364 Garden Cir., Longmont, Colo. 80501

[21] Appl. No.: 789,379

[22] Filed: Oct. 21, 1985

[51] Int. Cl.[4] ..... A63H 3/04

[52] U.S. Cl. ..... 446/267; 446/374; 428/16

[58] Field of Search ..... 446/374, 385, 392, 373, 446/370, 268, 267, 368, 490, 375, 382, 391, 491, 389, 378, 219; 63/DIG. 3, 5 A, 11; 428/17, 16; 174/112

[56] References Cited

U.S. PATENT DOCUMENTS

| | | | |
|---|---|---|---|
| 2,219,130 | 10/1940 | Herrmann | 446/374 X |
| 2,628,998 | 2/1953 | Frisbie | 174/112 |
| 2,738,616 | 3/1956 | Windle | 446/267 |
| 3,176,431 | 4/1965 | Richardson et al. | 446/378 X |

FOREIGN PATENT DOCUMENTS

| | | | |
|---|---|---|---|
| 2256635 | 7/1975 | France | 446/385 |
| 867386 | 5/1961 | United Kingdom | 446/385 |

OTHER PUBLICATIONS

U.S. patent application, Ser. No. 218,848, published Jun. 1943, Inventor: C. M. Beckett.

*Primary Examiner*—Mickey Yu

*Attorney, Agent, or Firm*—Dean P. Edmundson

[57] ABSTRACT

An amusement device is described which comprises an elongated, flexible, tubular sheath having two ends. A shape-forming core member is contained within the sheath and extends through substantially the length of the sheath. An end cap is secured to each end of the sheath. The amusement device may be shaped into any desired shape or configuration and it will retain that shape until the user desires to change the shape.

12 Claims, 13 Drawing Figures

FLEXIBLE TUBULAR TOY

FIELD OF THE INVENTION

This invention relates to amusement devices. More particularly, this invention relates to an amusement device which may be shaped or formed into any desired configuration. Shaped forms may resemble animals, insects, faces, etc.

BACKGROUND OF THE INVENTION

Amusement devices and toys of various designs have heretofore been proposed and developed. However, few of such devices or toys enable a person, young or old, to use his or her imagination to any great extent.

U.S. Pat. No. 3,597,872 describes a toy composed of a plurality of connected rigid bodies (e.g., wood, plastic, metal, etc). The bodies are arranged in a row and may be rotated to a limited extent relative to an adjacent body. Although such a toy may be shaped into a variety of different forms, the number of possible shapes which may be formed is inherently limited. Furthermore, the several bodies are made of a rigid material which may make the toy unsuitable for children of certain ages or mentalities. Moreover, since the number of variations permissible in shaping the product is inherently limited, older children and adults may easily and quickly tire of the toy because it can no longer stimulate their imagination.

The present invention overcomes these deficiencies of the prior toy.

SUMMARY OF THE PRESENT INVENTION

In accordance with the present invention there is provided an amusement device comprising an elongated, flexible, tubular sheath having first and second ends. A shape-forming core member is contained within the tubular sheath and extends substantially through the entire length of the sheath. An end cap is secured to each of the ends of the sheath. One or both of the end caps may simulate an eye, a head shape, tail member, etc.

The device of the invention may be formed into any desired shape or configuration, and the device is adapted to retain such desired shape so that it may be displayed on a shelf, table, desk, etc. When it is desired to form a new shape, the user may bend or twist it into any desired new shape or configuration. The device of this invention may be shaped in an infinite number of configurations and therefore does not limit the user's imagination. As a result, the device is capable of entertaining young and old persons. Also, the device is safe for use by children.

The amusement device may also include a colored filling material, e.g., colored particulate material or a colored liquid. The colored material may also comprise a colored sleeve disposed between the core member and the tubular sheath.

BRIEF DESCRIPTION OF THE DRAWINGS

The invention is described in more detail hereinafter with reference to the accompanying drawings, wherein like reference characters refer to the same parts through the several views and in which.

DETAILED DESCRIPTION OF THE INVENTION

Figure 1:
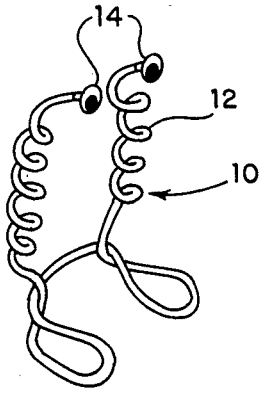
FIG. 1 is a perspective view of one embodiment of amusement device of the invention which has been shaped into one possible configuration.
Figure 2:
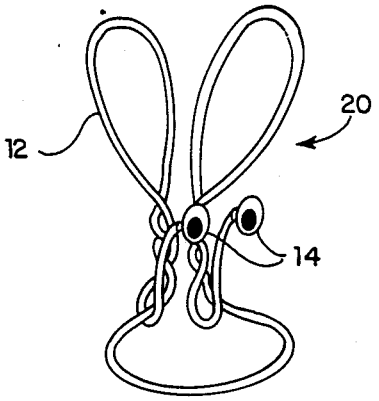
FIG. 2 is a perspective view of another embodiment of amusement device of the invention which has been shaped into another possible configuration.

In FIGS. 1 and 2 there are shown two embodiments of amusement devices 10 and 20 of the invention. Each embodiment comprises an elongated, flexible, tubular sheath 12, a shape-forming core member (not shown) within the tubular sheath, and an end cap 14 secured to each end of the tubular sheath. In the embodiments of FIGS. 1 and 2 the end caps simulate eyeballs.

The resulting shaped figures resemble characters, animals, insects, or any other desired figure. The advantage of the amusement devices of this invention is that a single device can be repeatedly shaped or formed into any desired configurations, as determined by the imagination of the person using the device. This enables a person to be creative in the use of the device. Also, the device is very safe for use as a toy, although not recommended for pre-school children.

Figure 3:
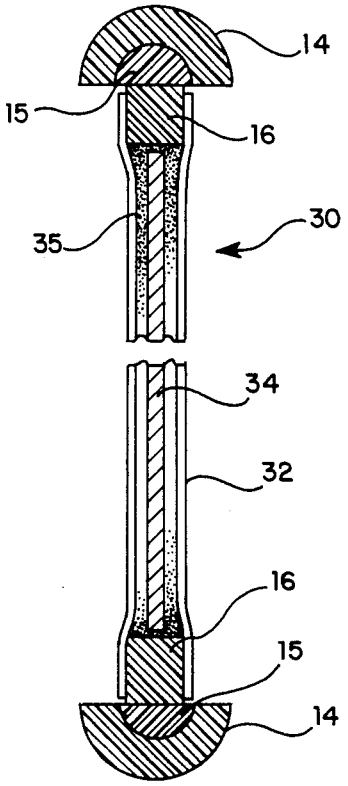
FIG. 3 is a cross-sectional view of one embodiment of amusement device of the invention.

In FIG. 3 there is shown a cross-sectional view of one embodiment of amusement device 30 comprising a flexible, elongated, tubular shaft 32 having two ends. A shape-forming core member 34 is disposed within the tubular sheath and extends through substantially the entire length of the sheath, as shown. End caps 14 are secured to the ends of the sheath. In this embodiment there is also included a colored filling material 35 comprising particulate or granular material.

The tubular sheath of the devices of this invention must be flexible so that it may be bent, twisted or otherwise shaped to the desired configuration. Particularly useful materials include rubber or plastic (e.g., vinyl) tubing which is pliable, water-resistant, and durable. Preferably the sheath is transparent. Alternatively the sheath may be composed of fabric.

The length and diameter of the sheath may vary. For example, the length may vary from a few inches to a few feet. The diameter of the sheath may vary from a fraction of an inch to more than an inch. Generally speaking, sheaths having larger diameters have less flexibility than those of small diameters. Accordingly, the larger the diameter of the sheath the greater the length should be to obtain the desired degree of flexibility.

A particularly useful tubular sheath which has been used in devices of the invention is a flexible, transparent vinyl tubing. The inside diameter is 0.125 inch, the outside diameter is 0.25 inch and the wall thickness is 0.0625 inch. It may have a length of five feet or more, if desired.

Although the tubular sheath may be transparent or translucent, it may also be colored, if desired. For example, it may have colored particulate material (i.e., glitter or other colored particles) included in the walls of the sheath. Alternatively, the sheath may be formed from colored resin.

The shape-forming core member within the tubular sheath may be solid or braided wire, e.g., steel, aluminum, copper, etc. The core member is flexible, enabling it to be bent, within the sheath, to any desired configuration. Yet, the core member has sufficient rigidity to be capable of holding or retaining the sheath in the desired shape after bending. The core member thus has sufficient thickness to provide the required degree of rigidity to the shaped configuration, yet the core member has sufficient flexibility to enable it to be shaped into the desired configuration. A particularly useful core member comprises a solid steel wire with high carbon content. Wire with a high carbon content enables the wire to be bent repeatedly without breaking.

The coloring material 35, shown in FIG. 3, is preferably a particulate or granular material such as common glitter or other such attractive material. It is also possible to use other types of conventional colored particles such as regular or irregular plastic bits, beads, sequins, powders, sand, etc. The coloring material shown in FIG. 3 fills the space between the core member 34 and the interior walls of tubular sheath 32.

An effective method for filling the sheath with a colored particulate material is to first insert the core member into the sheath and affix or secure one end cap 14 to one end of the sheath. The sheath is then held in vertical position with the open end up. The particulate material is placed in a hopper assembly which funnels the particulate material to the open end of the sheath. The sheath and hopper are then vibrated (e.g., with an electric vibrating device or shaker) to facilitate packing of the particulate material into the sheath. This process also helps to center the wire within the sheath. It has been found that it is preferred to impart vibration, as described above, only to the upper end of the sheath and to the hopper assembly holding the particulate material, while at the same time preventing the lower end of the sheath from vibrating. However, it is possible to also impart vibration to the lower end of the sheath, if desired.

Figure 12:
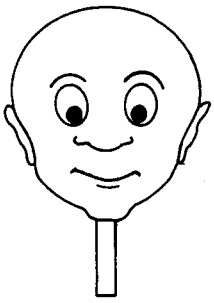
Figure 13:
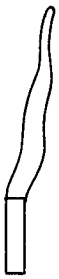

The end caps which are secured to the ends of the sheath may be composed of a variety of materials, such as plastic, rubber, wood, metal, etc. They may also have a variety of shapes, as illustrated in FIGS. 3, 4 and 9–13, including semi-spheres, spheres, polygonal, ovular, molded free form shape, etc. The end caps may simulate eyes (such as illustrated in FIGS. 1, 2, 3 and 4), or a head (such as illustrated in FIG. 12), or a tail (such as illustrated in FIG. 13), or any other desired feature or shape. To further simulate an eye, the end caps 14, as shown, include a smaller semi-sphere 15 which is of a different color than the main body of the cap 14.

Figure 4:
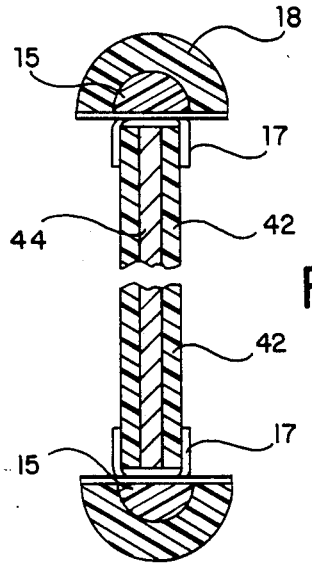
FIG. 4 is a cross-sectional view of another embodiment of amusement device of the invention.

The end caps may include a male portion 16 (illustrated in FIG. 3) of sufficiently large diameter that it is adapted to be firmly secured within the tubular sheath, as shown. Alternatively, the end cap may include a female portion 17 (as illustrated in FIG. 4) which is adapted to fit over and form a friction fit with the exterior surface of the sheath 42. FIGS. 9–13 also illustrate end caps employing a male portion for securement to the end of a tubular sheath. Although the end cap normally includes a portion having a greater diameter than the diameter of the sheath, FIG. 13 illustrates one embodiment of a tail which is not larger than the diameter of the sheath. The end caps on a particular sheath may be the same or different. If desired, the end caps may be secured to the sheath by means of adhesive, or one of them may even be integrally molded as a part of the sheath at one end.

FIG. 4 illustrates another embodiment of the invention in which the wire core member 44 is surrounded by the sheath 42, there being no cavity between the core member and the sheath. This embodiment may be formed by appropriate matching of the diameter of the core member and the inside diameter of the sheath, or it may be formed by molding the sheath material around the core member so as not to leave a cavity. In this embodiment it may be desirable to use a colored sheath or to have colored particles within the walls of the sheath.

Figure 5:
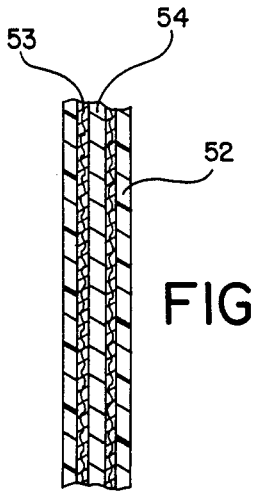
FIGS. 5–8 are cross-sectional views of still further embodiments of amusement devices of the invention.
Figure 9:
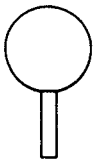
FIGS. 9–13 are elevational views of various types of end caps or plugs which are useful in the devices of the present invention.
Figure 10:
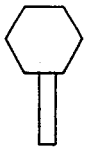
Figure 11:
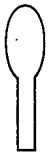

FIG. 5 illustrates another version of the invention in which a colored sleeve 53 is provided between the walls of the sheath 52 and the core member 54.

Figure 6:
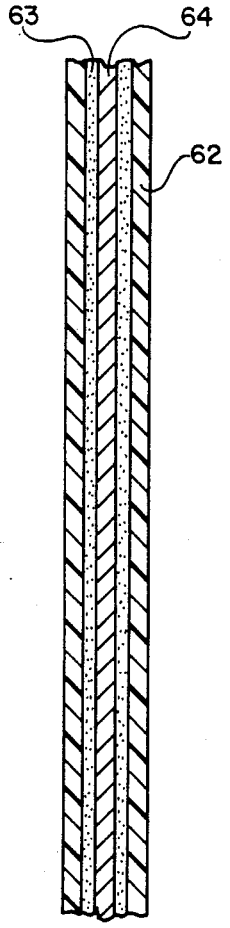

FIG. 6 illustrates yet another version of the invention in which the cavity between the core member 64 and the sheath 62 is filled with a liquid 63. The liquid may be, for example, an oil, or it may be gelled material. It may be colored, if desired.

Figure 7:
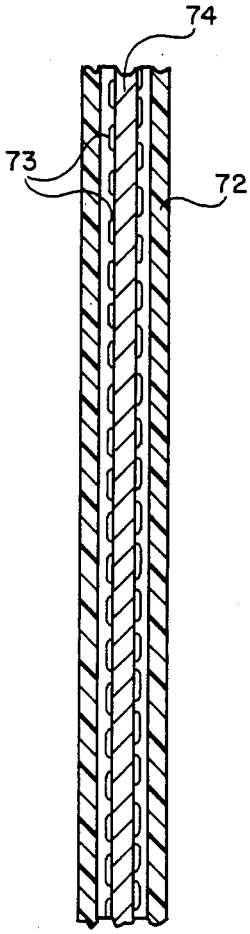

FIG. 7 illustrates still another version of the invention in which colored particles 73 are firmly bonded to the surface of the core member 74, which is then put into the interior of sheath 72, as shown.

Figure 8:
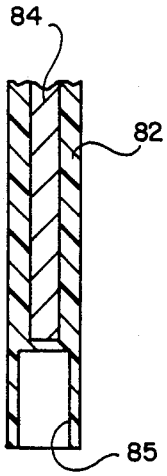

FIG. 8 illustrates another version in which the sheath material 82 has been molded around core member 84. The ends of the sheath include a molded cavity 85 for attachment of the desired end caps.

Other variants are possible without departing from the scope of this invention.

What is claimed is:

1. An amusement device comprising an elongated, flexible, transparent, tubular sheath having first and second ends, a shape-forming core member within said tubular sheath and extending substantially through the length of said tubular sheath, and an end cap secured to each of said first and second ends of said tubular sheath, wherein a liquid filling material is contained within said tubular sheath, and wherein said device is adapted to be formed into a desired shape and is further adapted to retain said desired shape.

2. An amusement device in accordance with claim 1, wherein said tubular sheath is composed of a material selected from the group consisting of plastic and rubber.

3. An amusement device in accordance with claim 1, wherein said core member comprises wire.

4. An amusement device in accordance with claim 1, wherein said tubular sheath is colored.

5. An amusement device in accordance with claim 1, wherein at least one of said end caps simulates an eye.

6. An amusement device in accordance with claim 1, wherein said shape-forming core member includes a colored sleeve.

7. An amusement device in accordance with claim 1, wherein said end caps are integral with said tubular sheath.

8. An amusement device in accordance with claim 1, wherein said end caps are composed of a material selected from the group consisting of plastic, rubber, metal and wood.

9. An amusement device comprising an elongated, flexible, transparent, tubular sheath having first and second ends, a wire core member within said tubular sheath and extending substantially through the length of said tubular sheath, an end cap secured to each of said first and second ends of said tubular sheath, and a liquid within said sheath, wherein said device is adapted to be formed into a desired shape and is further adapted to retain said desired shape.

10. An amusement device in accordance with claim 9, wherein said tubular sheath is composed of a material selected from the group consisting of plastic and rubber.

11. An amusement device in accordance with claim 9, wherein at least one of said end caps simulates an eye.

12. An amusement device in accordance with claim 9, wherein said end caps are integral with said tubular sheath.

* * * * *